United States Patent [19]

Marsh et al.

[11] 3,967,964

[45] July 6, 1976

[54] PHOTOSENSITIVE FILM COMPRISING AN ORGANOPOLYSELENIDE AND AN ORGANOMERCURY COMPOUND

[75] Inventors: Dana G. Marsh, Rochester; Joseph Y. C. Chu, Fairport, both of N.Y.

[73] Assignee: Xerox Corporation, Stamford, Conn.

[22] Filed: Aug. 1, 1975

[21] Appl. No.: 601,007

[52] U.S. Cl. ..... 96/48 R; 96/48 QP; 96/88; 96/119 PQ

[51] Int. Cl.[2] ..... G03C 5/24; G03C 1/00

[58] Field of Search ..... 96/48 R, 48 QP, 88, 96/119 QP, 1.5; 252/501

[56] References Cited

UNITED STATES PATENTS 3,440,046 4/1969 Droege et al. ..... 96/88

OTHER PUBLICATIONS

*Chem. Abstract*, vol. 75, 1971, 20550*f*.

Jackson – *Justus Liebigs Ann. Chem.*, 179, 1–20 (1875).

*Primary Examiner*—Won H. Louie, Jr.

*Attorney, Agent, or Firm*—James J. Ralebate; James P. O'Sullivan; Jerome L. Jeffers

[57] ABSTRACT

Polymeric matrices such as poly(vinylchloride) and poly(methylmethacrylate) loaded with mixtures of an organopolyselenide characterized by the formula:

$$R_1-(Se)_n-R_2$$

and an organomercury compound characterized by the formula:

$$R_3-Hg-R_4$$

form the basis for high resolution and contrast microimaging film systems. Irradiation of these films with activating radiation results in dark images in light struck areas and colorless background. The microimaging film is a negative working system with add-on reimaging capability. The images are stable to projection in conventional slide projection systems.

13 Claims, No Drawings

PHOTOSENSITIVE FILM COMPRISING AN ORGANOPOLYSELENIDE AND AN ORGANOMERCURY COMPOUND

BACKGROUND OF THE INVENTION

The light sensitivity of mercury compounds has long been recognized. Mercury salts of halogens, especially iodine, have been the subject of intense investigations which have formed the basis for fade-out imaging and imaging based upon the formation of colloidal mercury. Further work has shown that mixtures of mercurous iodide salts with silver iodide forms an extremely light sensitive system. The mercury metal catalysis of thermal decompositions of silver oxalate and mercurous oxalates have also been reported.

The light sensitivity of selenium and tellurium containing compounds and benzyldiselenide (BDS) was reported by C. L. Jackson in Justus Liebigs Ann. Chem., 179, 1 (1875) to photodecompose. Chu et al have reported in J. Amer. Chem. Soc., 97, 4905 (1975) that the primary photoproducts of the photolysis of BDS in solution at room temperature are dibenzylselenide and selenium atoms.

The use of metal chalcogenide systems as imaging materials has been reported by Shimizu et al. in Phot. Sci. and Eng., 16, 291 (1972). In these systems, metal layers deposited on the surface of chalcogenides were "photo-doped" into the chalcogenide resulting in changes in optical density in the light struck areas.

It is an object of the present invention to provide a novel microimaging film of a polymeric matrix containing an organochalcogen and an organomercury compound.

An additional object is to provide such a film which when exposed in an imagewise manner produces images of high density and good resolution.

A further object is to provide a method for imaging such a film.

SUMMARY OF THE INVENTION

The present invention is an imaging method which comprises exposing in an imagewise manner to activating radiation a film comprising:

a. an organic polymer as matrix material having uniformly dispersed therein:

i. an organopolyselenide characterized by the formula:

$$R_1-(Se)_n-R_2$$

wherein $n$ is 2 or 3; and $R_1$ and $R_2$ are aralkyl or alkyl hydrocarbon moieties; and ii. an organomercury compound characterized by the formula:

$$R_3-Hg-R_4$$

wherein $R_3$ and $R_4$ are aryl, aralkyl or alkyl moieties.

Also disclosed is a film useful in the above-described imaging process.

DETAILED DESCRIPTION AND PREFERRED EMBODIMENTS

The present invention is directed to microimaging films comprised of polymeric matrices, for example, poly(vinylchloride) or poly(methymethacrylate), containing two organometallic compounds, for example, benzyldiselenide and diphenylmercury. Upon irradiation, these photoreact to produce optically dense HgSe in the light struck areas.

Typically, the polymeric matrix material is comprised of an organic film forming polymer which forms a film which is transparent or translucent to the activating radiation used to image the film. The polymer may consist solely of carbon and hydrogen although substituted polymers such as poly(vinylchloride) may be used. Preferred polymers are those which have glass transition temperatures (Tg) greater than about 100°C. This is the case because the films are optionally heated after exposure to increase the optical density of the image and those polymers having glass transition temperatures below this heating temperature will tend to soften allowing the image forming particles to diffuse, which diffusion results in a decrease in resolution. Exemplary of polymers useful as the matrix polymer are poly(vinylformal), poly(vinylbutyral), poly(vinylalcohol), poly(methylmethacrylate), poly(vinylpyrrolidone), and poly(vinylidenechloride). Copolymers and block copolymers may also be employed as the matrix material.

The organoselenium compounds can be selected from compounds corresponding to the general formula previously set out. These compounds are capable of undergoing a decomposition reaction in response to activating radiation and yielding, as one of the products of such decomposition, elemental selenium. Organo selenium compounds useful in the present process include organoselenides of the formula:

$$R_1-(Se)_n-R_2$$

wherein $R_1$ and $R_2$ are independently selected from the group of benzyl, alkyl substituted benzyl, amino substituted benzyl, amido substituted benzyl, arylalkyl substituted benzyl, aryl substituted benzyl, alkoxy alkyl substituted benzyl, aryloxy alkyl substituted benzyl, amino alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxy substituted benzyl, cyano substituted benzyl, and alkyl, alkoxy, amino substituted alkyl, amido substituted alkyl, aryl alkyl, alkoxy alkyl, aryloxy alkyl, hydroxy substituted alkyl, carbonyl substituted alkyl, thio substituted alkyl, seleno substituted alkyl, carboxamido substituted alkyl, halogen substituted alkyl, carboxy substituted alkyl, cyano substituted alkyl, and nitro substituted alkyl; cyclo alkyl and substituted cyclo alkyl; heterocyclic moieties; and acyl moieties; and $n$ is 2 or 3.

Many of the compounds within the scope of the above formula are readily available from commerical sources and those not so available can be prepared by methods disclosed in the technical literature. For example, symmetrical dialkyl selenides can be prepared by the reaction of an alkyl halide with sodium selenide, M. L. Bird et al., J. Chem. Soc., 570 (1942); R. Peatzold et al. L. Amorg. Allg. Chem., 360, 293 (1968). The general method for the preparation of unsymmetrical dialkyl selenides is a modified Williamson synthesis, H. Rhemboldt, "Houben — Weyl Methodenider Organischen Chemie", Volume IX, E. Muller, Ed., Georg Thieme Verlag, Stuttgart, pp. 972, 1005, 1020 and 1030 (1955).

Diselenides within the scope of the above formula can be prepared by alkaline hydrolysis of organo selenacyanates (H. Baner, Ber., 46, 92 [1913]) or selenosulfates (W. H. H. Gunther and M. N. Salzman, Ann. N.Y., Acad, Sci., 192, 25 [1972]). The preparation of unsymmetrical diselenides suitable for use in the invention are typically prepared by the reaction of organic selenyl bromides with organic selenols, H. Rhembolt and E. Giesbrecht, Chem. Ber. 85, 357 (1952). Heterocyclic selenium compounds capable of undergoing substantial carbon-selenium bond scission upon irradiation with ultraviolet light can be prepared by reaction of organic bromides with organic selenium compounds, L. Chierici et al., Ric. Sci., 25, 2316 (1955).

Organopolyselenides, i.e. those compounds corresponding to the foregoing formula where $n$ is equal to 2 or 3 are prepared by techniques disclosed in the chemical literature such as the formation of aromatic triselenides by the reaction of aromatic selenenyl selenocyanates with thiols, H. Rheinboldt et al., Chem. Ber. 88 1 (1955).

It should be noted that certain alkyl substituted selenium compounds will be liquids when low molecular weight alkyl substituents are employed. Since solid materials are generally preferred due to ease of film formation, those dialkyl polyselenides in which the aggregate number of carbon atoms is at least about 20 will be preferred for film formation.

In addition to diphenyl mercury, other organomercury compounds are useful in the present invention. Exemplary of such compounds are perfluoro diphenyl mercury, di-p-tolyl mercury, bis(pentachlorophenyl) mercury, dibenzylmercury, bis (biphenyl) mercury, dimethylanaline mercury and dinapthol mercury. Exemplary of dialkyl mercury compounds suitable for use in the present invention are di-n-amylmercury, di-n-butylmercury, diethylmercury, di-n-hexylmercury, di-isoamylmercury, di-isobutylmercury, di-isopropylmercury and di-n-propylmercury.

Upon selection of the appropriate matrix polymer, organopolyselenide and organomercury compound, the imaging film is prepared by dissolving these constituents in a suitable solvent and applying the so-formed solution to a suitable substrate in a thin layer. Evaporation of the solvent leaves a film which, when exposed to activating radiation, bears a visible image corresponding to the exposed areas. Suitable solvents are those compositions which dissolve the materials and do not detrimentally interact with them. The solvent should be sufficiently volatile so as to be readily evaporated from the solutes. Useful solvents include tetrahydrofuran (THF), carbon disulfide, acetone and methyl ethyl ketone.

The relative proportions of the matrix polymer, organopolyselenide and organomercury compound are not critical, provided the matrix polymer is the principal ingredient. In general, the organopolyselenide will make up from 1 to 10 and preferably 3 to 5 weight percent of the film. The organomercury compound will be used in similar amounts.

Exemplary of substrates upon which the films may be cast are Mylar, glass, metals and coated papers. If desired, the dried film can be stripped from the substrate either before or after imaging. The thickness of the film is not critical, but is generally greater than about 1 micron because of fabrication problems with submicron films. Thicknesses up to about 5 microns or more are satisfactory. The process of coating the film may include roller coating, knife coating, mil coating, brushing, etc. A preferred method is to use a doctor blade as applicator.

Upon casting the film and evaporating the solvent, optionally with gentle heating to accelerate solvent removal, the composition is ready for imaging which is accomplished by subjecting it to activating radiation in an imagewise fashion, i.e. irradiating the film in those areas in which the image is desired. This is normally accomplished by placing a stencil or negative having areas which are opaque and transparent to the radiation between the light source and the film and directing the light source through this barrier to the film.

That wavelength of electromagnetic radiation which is activating for purposes of imaging the film will depend, to some extent, on the particular reactants employed in a given film. The radiation should be of a wavelength which will activate the organopolyselenide and organomercury compound and cause them to yield selenium and mercury atoms respectively. Typically, radiation in the ultraviolet region of the spectra is employed, although radiation in the visible region especially in the near ultraviolet portion, may be employed in some cases. Experiments with dibenzylselenide and diphenyl mercury indicate that radiation of less than about 500 nm is preferred although films containing these contituents show some sensitivity up to about 800 nm.

Upon imagewise exposure of the film, the exposed portions undergo a change in optical density thereby providing an image. High resolution images can be prepared and the change in optical density can be increased by heating the imaged film, normally to a temperature of up to about 100°–120°C. While the heating step increases the contrast of the image, it may have a deleterious effect on its resolution. Thus, the heating step should be considered optional and not employed where high resolution is desired.

While the present invention is not predicated upon any particular theory of operation, it is believed that the change in optical density upon exposure and subsequent heat treatment is as represented by the following equations:

$$\phi\text{—Hg—}\phi \xrightarrow{h\gamma} \phi\text{—Hg—}\phi^* \qquad 1.$$

$$2.\ \phi - \mathrm{Hg} - \phi^* \rightarrow \phi - \mathrm{Hg} - \phi$$

$$3.\ \phi - \mathrm{Hg} - \phi^* \rightarrow \phi - \phi + \mathrm{Hg}$$

$$\mathrm{R—SeSe—R} \xrightarrow{h\gamma} \mathrm{R—SeSe—R^*} \qquad 4.$$

$$5.\ \mathrm{R - SeSe - R^*} \rightarrow \mathrm{R - SeSe - R}$$

$$6.\ \mathrm{R - SeSe - R^*} \rightarrow \mathrm{R - Se\cdot + .Se - R}$$

$$7.\ \mathrm{R - SeSe - R^*} \rightarrow \mathrm{R - SeSe\cdot + .R}$$

$$8.\ \mathrm{R - SeSe\cdot} \rightarrow \mathrm{R - Se\cdot + Se}$$

Equations (1) through (7) correspond to primary photochemical events for benzyldiselenide, BDS, and for diphenylmercury, DPM. Equations (2) and (5), for example, are deactivations of the excited species via collisions. Equations (3), (6) and (7) correspond to carbon-mercury, selenium-selenium and carbon-selenium bond scissions respectively. Equation (6) is not believed to be important in the formation of selenium atoms, since the back reaction, equation (12), infra, in likely to be quite efficient in the solid state by analogy with results reported in the solution photoreactions of BDS. The reaction steps shown in equations (7) and (8) are believed primarily responsible for the formation of selenium atoms.

Upon formation of mercury and selenium atoms, the following equations (9) through (14) are believed to represent the phenomena responsible for the change in optical density while the secondary radical reactions of benzyl radicals shown in equations (15) and (16) lead to dibenzylselenide and bibenzyl.

9. $X\,Se \rightarrow (Se)_x$

10. $yHg \rightarrow (Hg)_y$

11. $Se + Hg \rightarrow HgSe$

12. $2\,R - Se\cdot \rightarrow R - SeSe - R$

13. $Hg + RSeSeR \rightarrow RSeHgSeR$

14. $RSeHgSeR \rightarrow HgSe + RSeR$

15. $R\cdot + R - Se\cdot \rightarrow R - Se - R$

16. $2\,R\cdot \rightarrow R - R$

The mechanistic steps set out in equations (9), (10), (11) and (14) are believed to be responsible for the changes in optical density corresponding to the imaged area of the film. The association of selenium atoms results in brown-red images in the films which do not contain diphenylmercury. Irradiation of films that contain only diphenylmercury results in a film of mercury near the surface of the film closest to the irradiation source. This mercury layer is easily removed by mild mechanical abrasion.

3% loading of benzyldiselenide in PMMA, after 5 minutes exposure to 365 nm light (0.42 joule/cm$^2$) and 2 minutes heat treatment at 120°C and a PMMA film containing 3% each of benzyldiselenide and diphenylmercury treated similarly, that the film containing both reagents achieves a greater Δ O.D. at all wavelengths (300 to 800 nm) and that light absorption of the film is extended to greater than 800 nm. This increase in optical density is due to formation of mercuryselenide particles. The formation of HgSe is increased by heating to 120°C, and since neither benzyldiselenide nor diphenylmercury are decomposed thermally at 120°C, the heating step does not lead to increases in optical density in the background or unexposed areas.

The invention is further illustrated by the following examples.

EXAMPLES I – XVI

A series of imaging films are prepared by solvent casting (from THF) polymer solutions containing benzyldiselenide and diphenylmercury at various weight percent loadings onto Mylar substrates using a Gardner mechanical film coating apparatus with a 4 mil gap applicator bar. Both poly(vinylchloride), PVC, and poly(methylmethacrylate), PMMA, are used as matrix polymers. The cast films are dried carefully in a vacuum oven and stored in the dark at room temperature prior to exposure.

The films are exposed with light from a high pressure point source mercury arc operated at 100 watts. The 365 nm mercury line is the principal actinic wavelength for these films. Images are produced by exposing the films through an Air Force three bar resolution target which consists of a chrome-negative target on suprasil quartz. The target has seven groups with six elements each; the highest resolution of the target is 228 lp/mm.

Typical results for imaging films exposed as previously described wherein some of the imaged films are subjected to a heat treatment at 120°C for varying lengths of time are shown in Table I.

TABLE I

| Ex. No. | Matrix Polymer | Benzyl Diselenide wt.% | Diphenyl Mercury wt.% | Exposure Joules/cm$^2$ | Exposure time at 365 nm min. | Heating at 120° min. | Resolution lp/mm | Contrast C.D. above background |
|---|---|---|---|---|---|---|---|---|
| 1 | PVC | 1.0 | 1.0 | 0.5 | 6.0 | 2.0 | 18 | |
| 2 | PVC | 3.0 | 3.0 | 0.42 | 5.0 | — | — | 0.43 |
| 3 | PVC | 3.0 | 3.0 | 0.42 | 5.0 | 1.0 | — | 0.56 |
| 4 | PVC | 3.0 | 3.0 | 0.42 | 5.0 | 2.0 | — | 0.61 |
| 5 | PMMA | 1.0 | 1.0 | 0.5 | 6.0 | 2.0 | 180 | |
| 6 | PMMA | 1.0 | 1.0 | 0.5 | 6.0 | — | 228 | |
| 7 | PMMA | 3.0 | 3.0 | 0.5 | 6.0 | 2.0 | 180 | |
| 8 | PMMA | 3.0 | 3.0 | 0.5 | 6.0 | — | 228 | |
| 9 | PMMA | 3.0 | 3.0 | 0.42 | 5.0 | — | 228 | 0.84 |
| 10 | PMMA | 3.0 | 3.0 | 0.42 | 5.0 | 0.5 | 180 | 0.88 |
| 11 | PMMA | 3.0 | 3.0 | 0.42 | 5.0 | 2.0 | 180 | 1.03 |
| 12 | PMMA | 3.0 | 3.0 | 0.17 | 2.0 | — | — | 0.70 |
| 13 | PMMA | 3.0 | 3.0 | 0.17 | 2.0 | 5.0 | — | 0.81 |
| 14 | PMMA | 3.0 | 3.0 | 0.08 | 1.0 | — | — | 0.43 |
| 15 | PMMA | 3.0 | 3.0 | 0.08 | 1.0 | 1.0 | — | 0.53 |
| 16 | PMMA | 3.0 | 3.0 | 0.08 | 1.0 | 2.0 | — | 0.57 |

By contrast, the irradiation of films containing both benzyldiselenide and diphenylmercury results in the formation of dark brown images with a metallic luster. Subsequent heating of the imaged films results in an increase in the difference in optical density between imaged and background areas. This is born out by the results for poly(methylmethacrylate) polymers containing BDS and DPM. It has been found comparing the Δ O.D. (optical density above background) for a Examples 1–4 correspond to films in which PVC is the polymeric matrix. The resolution of these films is about 18 lp/mm, and the contrast (optical density, O.D, above background determined at 400 nm) varies from about 0.4 to 0.6 depending upon the length of heat development used.

The resolution of images in the PMMA matrix films, Examples 5–16, is superior to the resolution achieved in the PVC matrix films. In general, a resolution of at least 228 lp/mm is achieved after direct imaging for PMMA, compared to about 18 lp/mm for the PVC films. The image resolution in either polymer matrix is degraded after thermal treatment while optical density is increased. In the case of the PMMA matrix films, the resolution is 180 lp/mm after imaging. The poorer performance upon heat treatment of the PVC films may be related to the lower Tg for the PVC (Tg=80°C) as compaed to a Tg of 120°C for PMMA. Since the thermal treatment heats the PVC above its Tg, the selenium, mercury and mercuryselenide particles are able to migrate and diffuse and thereby degrade the image resolution to a greater extent than in the PMMA matrix. Another possible source of image degradation in the PVC matrix is the reaction of mercury atoms with the chlorine atoms on the backbone of the polymer.

EXAMPLES XVII – XXII

A series of 6 films are prepared with various weight percent loadings of benzyldiselenide and diphenylmercury. The films are prepared using poly(vinylchloride) as the matrix polymer and are imaged by 2 minute exposure with a 4 watt low pressure mercury lamp to provide 0.8 joule/cm$^2$ of exposure energy. Films 17, 19 and 21 are not heated after exposure whereas films 18, 20 and 22 are heated at 120°C for 1 minute.

The films are studied by transmission electron microscope (TEM) at magnification of 100K, the results of which are set out in Table II.

TABLE II

| Ex. No. | Benzyl Diselenide % wt. | Diphenyl Mercury % wt. | Description of TEM results. |
|---|---|---|---|
| 17 | 1.0 | 0.5 | Particles generally 0.004 μm (40A) in diameter uniformly distributed with a few ranging in size to about 0.020 μm (200A). Figure 3. |
| 18 | 1.0 | 0.5 | A bi-modal distribution of equally distributed particles having diameters of 0.0075 μm (75A) and 0.025 μm (250A). Figure 4. |
| 19 | 1.0 | 1.0 | A high population of particles evenly distributed, the average particle diameter is 0.005 μm (50A) with a few reaching a size of 0.020 μm (200A). Figure 5. |
| 20 | 1.0 | 1.0 | A high population of particles with diameters generally 0.010 μm (100A) with a few reaching as large as 0.040 μm (400A). Figure 6. |
| 21 | 1.0 | 1.5 | A few particles uniformly distributed generally less than 0.010 μm (100A) in diameter. Figure 7. |
| 22 | 1.0 | 1.5 | A uniform high population of evenly distributed particles about 0.010 μm (100A) in diameter. Figure 8. |

The TEM observation of Example No. 17 reveals a high population of evenly distributed particles having an average particle size of 0.004 μm (40 A), with a few particles ranging in size up to 0.020 μm (200 A). One feature of this film is that there are no high populations of particles near the front surface of the film. This establishes that mercury atoms formed during photolysis of DPM have reacted with selenium atoms formed by concommitant photolysis of DBS prior to thermal treatment. If this reaction did not occur, a metallic film of mercury would be expected to form at this interface. The visual color of the image is a metallic yellow-orange in light struck areas in a colorless background.

In Example No. 18, the same film was imaged and then heat treated. The TEM observation of this film discloses a bimodal distribution of particles in which two particle sizes are equally distributed throughout the PVC matrix. The smaller particles have an average particle diameter of 0.0075 μm (75 A), and the larger particles are about 0.025 μm (250 A). It is believed the smaller particles correspond to HgSe particles that have resulted from agglomeration or coalescense of separated HgSe formed initially by photolysis. These are somewhat larger than those observed in the original imaged films. The larger particles are believed to be selenium particles formed in a manner analogous to the HgSe particles. Since there are not sufficient mercury atoms to react with all of the selenium atoms formed, the bimodal distribution results. The visual appearance of the imaged and heated film is metallic brown image areas in clear colorless backgrounds.

The situation in a PVC matrix containing equal weights of BDS and DPM is different. Examples 19 and 20 show results for imaged and imaged and heated films containing 1 weight percent of each reagent respectively. In run No. 19, a high population of evenly distributed particles having a particle diameter of 0.005 μm (50 A) is observed. A few particles with diameters up to 0.02 μm (200 A) may be observed. These results correspond to the formation of principally HgSe with a few particles of Se as well. In run No. 20, the effects of heating are to produce a high population of evenly distributed particles with an average diameter of about 0.01 μm (100 A) and a few larger particles ranging in size up to 0.04 μm (400 A). This represents a situation in which there are nearly equivalent amounts of mercury and selenium atoms which could be formed photolytically. The likelihood of forming HgSe is increased and the observed results bear this out. Heating has doubled the particle size of the HgSe particles and no bimodal distribution is observed. A few particles attributable to selenium aggregates are present in both the imaged and imaged and heated films.

The films of runs 21 and 22 are composed of PVC as matrix polymer containing 1.0 weight percent BDS and 1.5 weight percent of DPM. In this situation, there is excess mercury potentially available after photolysis. In run No. 21 there is observed a uniform distribution of particles whose diameters are about 0.01 μm (100 A). After heating (run No. 22) there is a high population of evenly distributed particles with an average particle diameter of about 0.01 μm (100 A). In this situation, heating enhances the separation of distinct particles but does not appreciably increase their average particle diameter. The visual appearance of the heated films for this composition, as well as the others which were heated, shows increased optical density in the imaged areas.

The trend of this series of films is toward greater optical density in the light struck areas relative to background with increasing concentration of DPM. However, at excess concentrations of DPM, in which potentially available mercury atoms exceed the available selenium atoms, the resulting particle diameter is no greater than when the concentrations of BDS and DPM are equivalent. The density of particles seems to be greater when mercury atoms are in excess, and there is a possibility that mercury atoms are sensitizing the decomposition of unreacted BDS. Another possibility is that the excess mercury atoms enhance the coalescence of previously formed HgSe molecules.

The experimental evidence presented in Examples I through XXII shows that an imaging system based upon the simultaneous formation of mercury and selenium atoms, with subsequent formation of molecules and aggregates of HgSe, can be used for preparing high resolution, medium contrast images. Samples of microimages prepared with this film have been projected on conventional slide projectors and resolutions up to about 18 lp/mm are readily attained on the viewing screen. The contrast between dark and light areas is good, and no appreciable deterioration of the film occurs after 30 minutes of continuous exposure to the visible light in the projector.

The micro-imaging film offers add-on capability by reimaging with ultraviolet light with wavelengths below about 360 nm. The film may be safely handled in room light for lengthy periods with no apparent deterioration.

What is claimed is:

1. An imaging method which comprises exposing in an imagewise manner to activating radiation a film comprising:

a. an organic polymer as matrix material having uniformly dispersed therein;

i. an organopolyselenide characterized by the formula:

$$R_1-(Se)_n-R_2$$

wherein $n$ is 2 or 3; and $R_1$ and $R_2$ are aralkyl or alkyl hydrocarbon moieties; and ii. an organomercury compound characterized by the formula:

$$R_3-Hg-R_4$$

wherein $R_3$ and $R_4$ are aryl, aralkyl or alkyl hydrocarbon moieties thereby forming dark brown images with a metallic luster.

2. The method of claim 1 wherein the organic polymer is poly(vinylformal), poly(vinylbutyral), poly(vinylalcohol), poly(methylmethacrylate), poly(vinylpyrrolidone) or poly (vinylidenechloride).

3. The method of claim 1 wherein $R_1$ and $R_2$ are independently selected from the group of benzyl, alkyl substituted benzyl, amino substituted benzyl, amido substituted benzyl, arylalkyl substituted benzyl, aryl substituted benzyl, alkoxy alkyl substituted benzyl, aryloxy alkyl substituted benzyl, amino alkyl substituted benzyl, alkyl amino substituted benzyl, aryl amino substituted benzyl, alkyl carbonyl substituted benzyl, alkyl thio substituted benzyl, alkyl seleno substituted benzyl, carboxamido substituted benzyl, halogen substituted benzyl, carboxyl substituted benzyl, cyano substituted benzyl, and alkyl, alkoxy, amino substituted alkyl, amido substituted alkyl, aryl alkyl, alkoxy alkyl, aryloxy alkyl, hydroxy substituted alkyl, carbonyl substituted alkyl, thio substituted alkyl, seleno substituted alkyl, carboxamido substituted alkyl, halogen substituted alkyl, carboxy substituted alkyl, cyano substituted alkyl, and nitro substituted alkyl; cyclo alkyl and substituted cyclo alkyl; heterocyclic radicals; and acyl radicals.

4. The method of claim 1 wherein the organomercury compound is diphenyl mercury, perfluoro diphenyl mercury, di-p-tolyl mercury, bis(pentachlorophenyl) mercury, dibenzylmercury, bis(biphenyl) mercury, dimethylanaline mercury and dinaphthol mercury, di-n-amylmercury, di-n-butylmercury, diethylmercury, di-n-hexylmercury, di-isoamylmercury, di-isobutylmercury, di-isopropylmercury or di-n-propylmercury.

5. The method of claim 1 wherein the organopolyselenide and organomercury compound each comprise from 1 to 10 weight percent of the film.

6. The method of claim 5 wherein the organopolyselenide and organomercury compound each comprise from 3 to 5 weight percent of the film.

7. The method of claim 1 wherein the exposed film is heated to enhance the image contrast.

8. The method of claim 7 wherein the film is heated to a temperature of from 100°–120°C.

9. The method of claim 1 wherein the film is exposed to ultraviolet radiation.

10. The method of claim 1 wherein the organopolyselenide is benzyldiselenide and the organomercury compound is diphenyl mercury.

11. The method of claim 10 wherein the matrix polymer is poly(vinylchloride).

12. The method of claim 10 wherein the matrix polymer is poly(methylmethacrylate).

13. A microimaging film which comprises:

a. an organic polymer as matrix material having uniformly dispersed therein;

i. an organopolyselenide characterized by the formula:

$$R_1-(Se)_n-R_2$$

wherein $n$ is 2 or 3; and $R_1$ and $R_2$ are aralkyl or alkyl hydrocarbon moieties; and ii. an organomercury compound characterized by the formula:

$$R_3-Hg-R_4$$

wherein $R_3$ and $R_4$ are aryl, aralkyl or alkyl hydrocarbon moieties.

* * * * *

UNITED STATES PATENT AND TRADEMARK OFFICE

CERTIFICATE OF CORRECTION

PATENT NO. : 3,967,964

DATED : July 6, 1976

INVENTOR(S) : Dana G. Marsh and Joseph Y. C. Chu

It is certified that error appears in the above-identified patent and that said Letters Patent are hereby corrected as shown below:

Column 3, line 5, "selenacyanates" should be corrected to read --selenocyanates--.

Column 7, line 9, "compaed" should be corrected to read --compared--.

Column 8, line 20, insert the word "particle" between the words "average" and "diameter".

Signed and Sealed this

Thirtieth Day of November 1976

[SEAL]

*Attest:*

RUTH C. MASON
*Attesting Officer*

C. MARSHALL DANN
*Commissioner of Patents and Trademarks*